United States Patent [19]

Nakajima

[11] 4,257,722

[45] Mar. 24, 1981

[54] PILE DRIVING METHOD

[75] Inventor: Hisaharu Nakajima, Onomichi, Japan

[73] Assignee: Toa Harbor Works Co., Ltd., Tokyo, Japan

[21] Appl. No.: 27,779

[22] Filed: Apr. 6, 1979

[30] Foreign Application Priority Data

Apr. 6, 1978 [JP] Japan ..... 53/41595

[51] Int. Cl.[3] ..... E02D 7/24

[52] U.S. Cl. ..... 405/248; 405/232

[58] Field of Search ..... 405/248, 231, 232, 236, 405/240; 125/210

[56] References Cited

U.S. PATENT DOCUMENTS

| | | | |
|---|---|---|---|
| 885,337 | 4/1908 | Gilbreth | 405/248 |
| 1,245,373 | 11/1917 | O'Donnell | 405/248 X |
| 1,644,560 | 10/1927 | Bignell | 405/231 X |
| 2,555,359 | 6/1951 | Montague | 405/240 X |
| 3,630,036 | 12/1971 | Van Weele | 405/248 X |
| 3,851,490 | 12/1974 | Matsushita | 405/248 |

*Primary Examiner*—Dennis L. Taylor

*Attorney, Agent, or Firm*—Armstrong, Nikaido, Marmelstein & Kubovcik

[57] ABSTRACT

An improved pile driving method is disclosed, which is particularly applicable in piling into a hard rock bed widely in the construction of buildings, bridges, harbor facilities, piers and so forth, and in which a high-pressure water guide pipe is attached to a pile to be driven, in a manner of being movable within a certain limit, and while effecting a removal of rock pieces produced by crushing by the pile driving, through jetting a water supplied under pressure through the guide pipe, driving of the pile is worked by a vibration pile driver. This method employs a reduced amount and suppressed pressure of water to be jetted in comparison to conventional methods.

12 Claims, 14 Drawing Figures

PILE DRIVING METHOD

BACKGROUND OF THE INVENTION

The present invention relates in general to a pile driving method and in particular, to an improved pile driving method by which piles can be relatively easily driven into a hard rock bed through utilization of a vibration pile driver and jetting of a high pressure water in combination.

In the field of construction in general including civil engineering, building construction and so forth, conventionally various methods are known for driving into a ground such objects as foundation piles, pillars, sheathing boards and the like. For example, the following are known and have been most widely employed: (1) methods utilizing impulsive force of a falling weight (such as drop hammering method, diesel pile hammering, and steam or compression air hammering), (2) a method utilizing vibration impulse (vibro-hammering method), (3) earth auger methods and (4) each of the above methods (1) to (3) incorporating an auxiliary method.

The pile driving is subject to a great influence with respect to the range of its possible application depending on the particular nature and, more particularly, the particular hardness of the ground for pile driving. The particular hardness may normally be represented in terms of the N value, which is shown by the number of hammerings required in a standard penetration test. In the standard test, a hammer of 63.5 kg in weight is freely dropped from 75 cm above, and the number of hammers is counted until the test sample hammered into has been penetrated to the depth of 30 cm. An N value of a higher value means a higher penetration resistance of ground and accordingly a harder ground condition.

In the instance of the current methods (1) above, the range of their possible application is limited to such a ground condition as having an N value below 50, and in case the piling ground has a greater N value, it can occur that the pile hammered comes out of an initially formed portion of the hall due to repellency of the hard ground or that the pile top becomes bent or otherwise damaged, whereby it often is completely infeasible to drive a pile.

With the vibro-hammering method, above (2), it comprises driving a pile as relied on vertical vibration applied at the head of the pile, and it has once drawn a wide attention in this field of the art for its advantage that it can be operated with less noise generation. However, its applicability is limited only to such ground conditions as having an N value not greater than 30, and as a method for pile driving under hard ground conditions, it fails to come up even to methods (1) above considered.

Then, with the above methods (3), they are also called drilling methods, according to which piles are driven to rotate and penetrated into a ground through their own rotation. The range of possible applicability in the case of methods (3) is further limited, and in terms of the N value, it is only within a range of 20—30.

The auxiliary method incorporated in most cases of the above (4) methods comprises jetting a relatively great amount of water under a relatively high pressure through a pipe fixed to a pile to be driven and thereby softening the ground in the vicinity of the pile top to facilitate the pile driving. In an actual example of the above vibro-hammering method (2) incorporated with such water jetting method, the pile driving is operated with use of a water supplied in an amount within a range of 1,000–2,000 l/min. and jetted under a pressure of from 100 to 200 kg/cm$^2$, and the limitation relative to the N value is alleviated in this case up to a value on the order of 40 to 50. Further, in the case of the drilling method (3) above, the applicability is widened to possibly cover even such ground conditions as having an N value up to about 50, by incorporating thereto a high-pressure water jetting within a same range as mentioned above of the amount and pressure of the water.

However, in accordance with any of the existing methods above referred to, it is virtually impossible to satisfactorily operate a pile driving into a harder bed and, more specifically, rock bed having an N value exceeding 50, and in often cases the operation cannot have a pile effectively driven into rock or, otherwise, results in breakage of the top of the pile. In the case of driving piles into a rock bed, one of the above methods (4) is generally employed, and normally in this case the water guide pipe is immovably fixed to the pile so as to move up and down in accordance with the movement of the pile being driven. If a high pressure water is jetted in such a great amount and under such a high pressure as to be within the above-mentioned ranges, through a guide pipe mounted in the above manner, the counteraction of the water jetting (similar to a rocket) can be of a considerable degree. Consequently the pile is subject to an accordingly considerable force application in the direction opposite of the pile driving direction. Thus, the pile driving force is greatly lessened, whereby it is made difficult to effectively drive piles into a rock bed as before mentioned.

As pointed out above, with each of the typical methods (1) through (4) of a wide employment today, a limitation is unavoidable that the ground for piling is to have an N value smaller than about 50, and in the circumstances it has been widely regarded that pile driving into a hard ground having and N value above 50, is completely infeasible. Then, in certain cases it is proposed to operate for example boring of a hard rock bed, followed by placing of a pile into the bore and driving thereof. However, the operation relied on such method is highly complex and more so when piling is to be made into an underwater rock bed.

Accordingly, there has been a strong demand for providing a method by which construction piles can be directly driven into a hard rock bed.

SUMMARY OF THE INVENTION

An object of the present invention is therefore to provide a pile driving method improved essentially in that it can drive piles even into a rock bed having so high an N value as above 50, into which a pile driving has been utterly infeasible according to conventional methods.

Another object of the invention is to provide an improved pile driving method by which a shape steel such as an H-section and I-section, steel pipe, steel sheet pile or the like can with ease be driven into a rock bed at a high operation efficiency and which can be economically applied to a wide range of pile driving operations.

To attain these and other objects, the present invention proposes such a method which broadly is characterized in that it includes the steps of supporting a water guide means movably along a pile to be driven into the ground or a rock bed, striking the pile at its top against the ground to crush the earth or rock, jetting a water delivered under pressure by the guide pipe in the vicinity of the pile to remove the crushed earth or rock away, and driving the pile into earth or rock bed by a vibration pile driver. More specifically, according to the present invention, characteristically a high pressure water guide pipe is supported along a pile to be driven or, more preferably, along an inside surface of the pile, in a manner of being movable within a certain limitation, and also a water delivered under pressure of a value lower than the ones employed in conventional methods is jetted in the vicinity of the top of the pile in an amount less than the conventionally employed amounts.

Since the water guide pipe is not immovably fixed but held to the pile movable in vertical and lateral directions within a certain limited area along the pile and since the pressure and the amount of water jetted are suppressed to be as low and little as possible respectively, the rocket-like counteraction force directly on the pile of the jetting of water is remarkably diminished and the force applied at the pile head can substantially be utilized for the driving of the pile, in accord with the method of the invention. Further, high pressure water can be jetted in the method of the invention at the moment the pile bottom undergoes reaction and leaves a hard bed against which the pile was hit by the vibration pile driver, towards an area beneath the bottom of the pile, whereby broken pieces of earth or rock can be cleaned away from beneath the bottom of the pile, therefore the pile driving can be worked with the force of vibro-hammering applied to the pile effectively acted directed upon the rock bed or ground. That is to say, with the method of the invention it is contemplated not to allow the force of jetted high pressure water to act upon the pile as much as possible, and at the same time, to constantly keep an area on the piling bed located virtually beneath the bottom of the pile to be cleaned off with crushed rocks or soil, so that the force of vibro-hammering of the vibration pile driver may not be cushioned due to the presence of crushed pieces of rock or the like but be transmitted immediately to the ground through the pile.

In accordance with the method of the present invention having characteristics as broadly summarized above, it is feasible to drive directly into a rock bed having an N value above 50 a steel pier or pile such as a steel pipe, H-section, I section or a steel sheet plate and so forth. Also, the piling operation can be done with only a reduced gap produced longitudinally between the pile and the ground or without damaging at any considerable extend an area of the piling bed around the pile being driven.

Further, an accurate pile driving according to the present invention can be carried out not only on land but also on shore. Moreover, the method of the present invention can be effectively employed for inclined driving of piles. Thus, the present invention can have a wide range of application, for example, in constructing in rock bed regions such as piers, breakwaters, bridges and so forth.

BRIEF DESCRIPTION OF THE DRAWINGS

These and other objects, characteristics and advantages of the present invention will become more fully apparent as the following description is read in conjunction with the drawings, in which.

DETAILED DESCRIPTION OF THE PREFERRED EMBODIMENTS OF THE INVENTION

Figure 1:
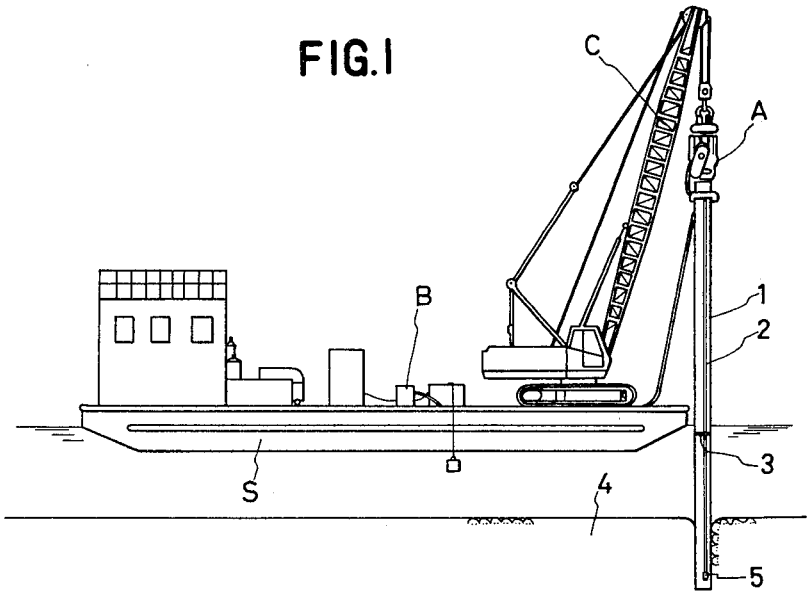
FIG. 1 is a view taken for a general illustration of the operation, in an offshore condion, of the pile driving method according to the present invention.

Referring now to the drawings and FIG. 1 initially, therein a vibration pile driver A is hung by a crane C carried on a work ship S and a pile 1 is in the process of being driven into an underwater rock bed 4 by the driver A. Longitudinally along the pile 1, a high pressure water pipe 2 is disposed, which is supported longitudinally at an intermediate point, relative to the pile 1, by a guide member 3 secured to the pile. Through this pipe 2, water is supplied under pressure from a pressure pump B also carried on the ship S, to be jetted in the vicinity of the bottom of the pile.

The water guide pipe 2 is not immovably attached to the pile but is held by the guide member 3 in a manner such that between the pile and the guide member it can move in the vertical direction and, in a modified embodiment of the invention, also in both vertical and lateral directions.

Figure 5:
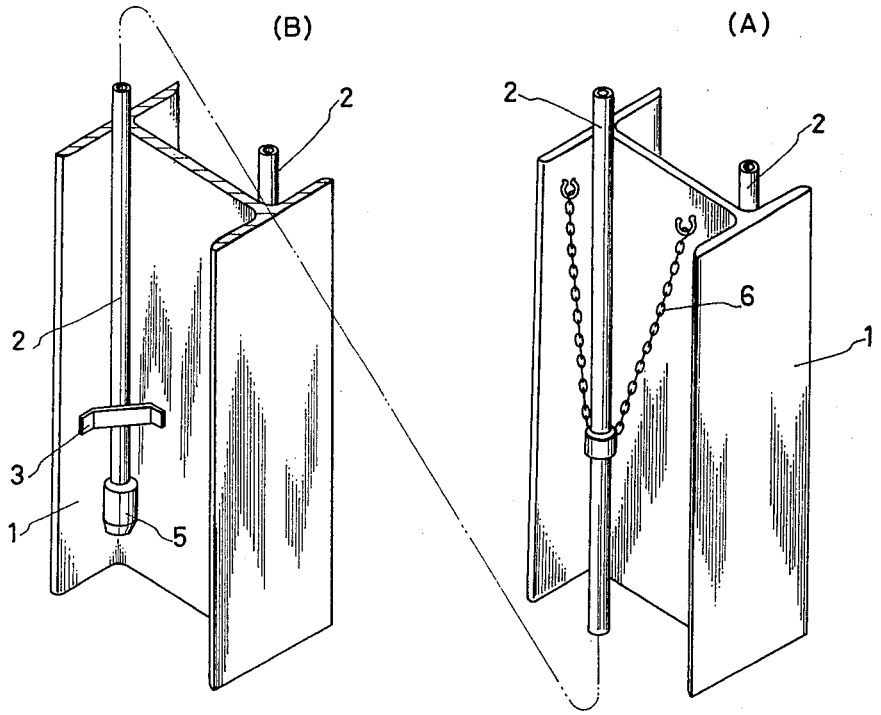
FIGS. 5A and 5B are perspective views, illustrating such an aspect of the invention in which the water guide pipe is disposed along an I-section pile and held to the pile by hanging with a chain.

The guide member 3 is a member for supporting the water pipe 2 until a nozzle 5 (FIG. 5B) secured to the leading end of the pipe has been sent into the rock bed 4 deep enough so that the guide member is at the surface of the rock bed, and as soon as the pile 2 is driven deeper, the guide member is automatically removed as a result of its forced collision with the rock bed surface. Thus, if the guide member is firmly secured to the pile 1, it would give rise to resistance against the pile driving, and too positive an attachment of the member 3 to the pile should preferably be avoided.

The amount and pressure of water to be jetted according to the method of the invention are considerably smaller and lower respectively, in comparison to those employed in the conventional method: In practice, the amount of water per pipe is in the invention within a range of 20–40 l/min. and, more preferably, 35–40 l/min., while the pressure being generally within a range of 30–60 kg/cm$^2$ and, more preferably, 40–50 kg/cm$^2$. Particular amount and pressure of water may be determined depending on the particular configuration and size of a pier or pile to be driven and the particular nature of the piling ground or rock bed. In this connection, it will be understood that the jetting of water is employed in the present invention not directly for breaking into small pieces and agitating the ground rock to facilitate penetration of the pile but rather for removing broken pieces of rock otherwise likely to remain present substantially beneath the bottom of the pile to keep in a sweeped-up condition an area of the ground or rock bed lying virtually beneath the bottom of the pile being driven.

Figure 7:
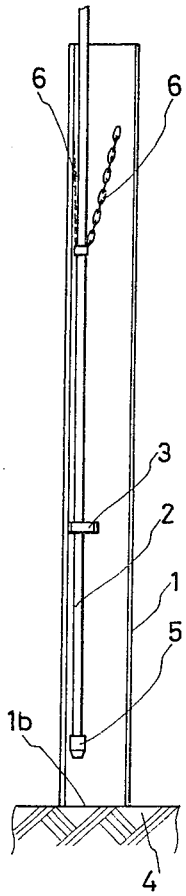
FIGS. 7 to 11 are respectively an elevation, illustrating an operational aspect during the pile driving operation in accord with the invention.

FIGS. 7 through 11 illustrate various operational aspects during pile driving according to the present invention, and as shown in FIG. 7 initially, the pile 1 hung by the crane C (FIG. 1) may be lowered to become seated on the ground or rock bed 4. The water guide pipe 2, which is supported by the pile in a manner of a certain limited freedom of motion as later to be described in greater detail, may be hung down through a flexible member 6 comprising a chain, rope or the like. In the illustrated embodiment of the invention, the support member 6 comprises a chain, which can be used in a number of two (2) or more.

Figure 8:
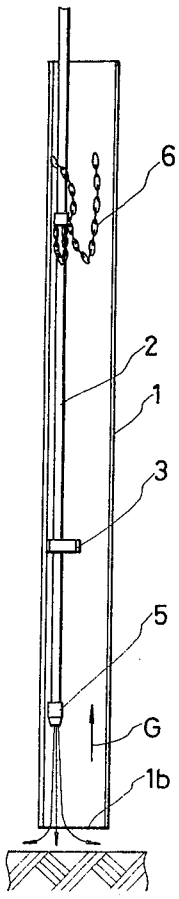

Subsequent to the seating of the pile as above, water may be supplied under pressure through pipe 2, and while it is jetted through the nozzle 5, the pile 1 may be hammered as its head by the vibration driver A, whereupon it will reacts to jump up as shown in FIG. 8. Accompanying such motion of pile 1, the water pipe 2 jumps up, but inasmuch as it is relatively freely supported relative to the pile, it can instantaneously undergo falling on account of its dead weight.

Figure 9:
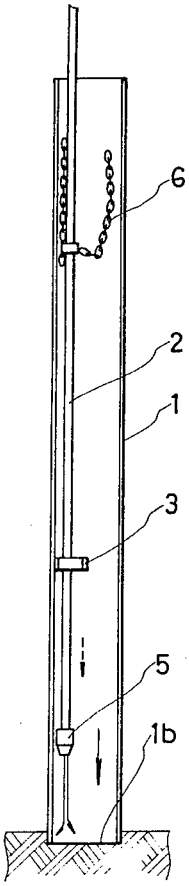

Then, as shown in FIG. 9, the pile is driven to hit its bottom strongly against the rock bed to have its head driven into the bed. At this point of the operation, the pipe 2 follows the pipe in motion and falls, and blows off crushed rock pieces, sand and the like with the high pressure water delivered through the same and jetted through the nozzle 5.

Figure 10:
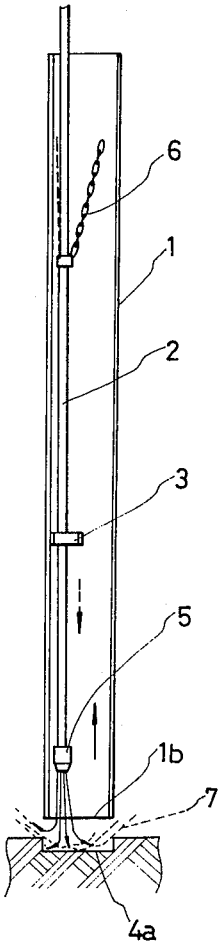

Whereas the pile 1 will then undergo rising responsive to repellency of the rock bed as shown in FIG. 10, the nozzle 5 is then located closest to the pile hitting area of the bed 4 and the high pressure water jetted through the same will blow off and remove from the hole 4*a* dug by the pile crushed rock pieces, sand or the like indicated at 7, which can function as a buffer member if present at the pile hitting area.

Figure 11:
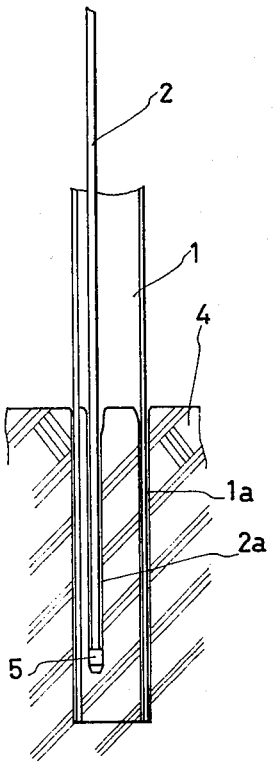

In a further advanced stage of the pile driving operation, both pile 1 and pipe 2 are penetrated into the ground or rock bed as shown in FIG. 11. At this point, the surface of the ground or rock bed is located above the point at which the guide member 3 was located. That is to say, the guide member 3 has already been removed automatically at this stage of the operation.

Figure 12:
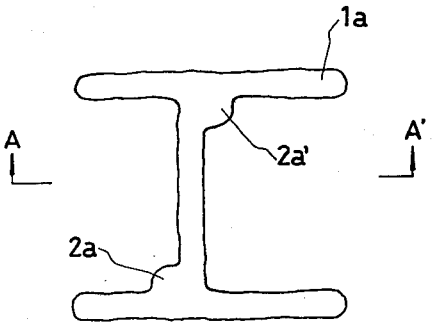
FIG. 12 is a top plan view of a hole formed into a rock bed when an H-section pile has been driven into same according to the invention.
Figure 13:
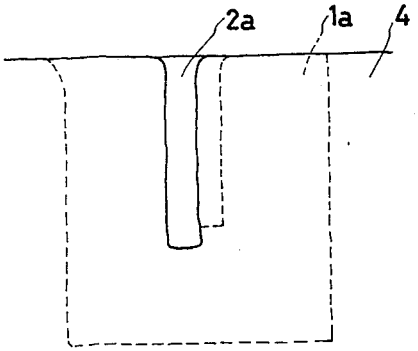
FIG. 13 is a sectional view taken in the direction of arrows A—A' of FIG. 12.

As a result of the pile driving as described above, there becomes a hole 1*a* formed in the rock bed as shown in FIGS. 12 and 13, in which holes 2*a* and 2*a'* are ones formed by two water guide pipes 2. It will be understood that nozzles 5 of the two pipes 2 have formed holes 2*a* and 2*a'* communicated with the hole 1*a* formed by the pile 1.

The method of the present invention, which is put into operation as described above, is based on the following basic concept of the pile driving.

When the pile hitting area on the ground or rock bed is kept free of sand, crushed rocks and the like, the driving force applied to the pile by the vibration pile driver may not be weakened by cushioning function likely in case of the presence of crushed rocks or the like and can be acted through the pile head directly upon the rock bed substantially without any loss of the force applied. Further, if the amount of water supplied through pipe 2 is reduced and the pressure thereof is suppressed, and in addition, if the pipe is supported relatively freely movable along the pile 1, as proposed according to the present invention, a propulsive force otherwise transmitted directly to the pile upon jetting the high pressure water through the pipe can be effectively diminished, whereby not only the driving force can be made functioning directly for the pile driving but also can be checked a damage to the bottom 1*b* of the pile which is likely if the pile is subject to functioning of pressure water jetting to undergo uncontrolled vertical motion.

In order to facilitate understanding of the above principles of the present invention, the pile driving operation according to the invention may now be put for a further detailed consideration with reference to FIGS. 7 through 11.

Upon hitting, the top 1*b* of pile 1 will break a surface portion of the rock bed 4 and, at the same time, receives repulsion of the rock bed to come up, whereby there becomes a gap produced between the top 1*b* of the pile and the crushed rock bed surface. At this moment, the high pressure water guided through pipe 2 is jetted to blow off crushed rock pieces along the inner or outer side of pile 1, and the pipe 2 becomes lifted responsive to the propulsion of the water jetting. The pile will again be driven to strike the rock bed and, crushing the rock, become repelled towards up by the rock, when the pipe 2 undergoes a downward motion in accordance with the driven motion of pile 1. Thus, the pile and the water guide pipe are caused to do up and down mortion in an alternate manner to carry out pile driving into the rock base while crushed fragments of rock are removed away about the pile hitting area of the rock bed.

As before stated, according to the present invention the high pressure water guide pipe 2 is supported along the length of the pier or pile 1, and preferably, it may be disposed in the inside of the shape steel pipe: In the case of the pile being a steel pipe, the inside termed above means the circular cross-sectional area within the inner wall surface of the pipe; in the case of an H-section or I-section pile, the area defined within a rectangular or square shaped depicted by lines connecting the ends of facing flanges in section of the H or I section, or a vicinity of such area; and in the case of a steel sheet pile, the rectangular or square area or a vicinity thereof surrounded by the piles disposed in cross section in a rectangular or square arrangement.

The water guide pipe 2 may be used in a number suitably determined in consideration of the particularity concerning the configuration and size of the pile to be handled and the nature of the rock or ground into which the pile is supposed to be driven. In other words, if with a single pipe 2 alone a sufficient amount of the high pressure water cannot be supplied for effectively removing crushed rocks and sand in the vicinity of the pile hitting area, the number of the pipe may be suitably increased.

The method of the present invention can be without change applied to driving any of steel sheet piles, steel pipes, H- or I-section steels and so forth. Moreover, its application is not limited only to a case as illustrated in FIG. 1 of driving of piles in an offshore condition but can with more ease be made under general onshore conditions.

As described in brief before, according to the present invention the water guide pipe 2 is supported preferably along an inside portion of the pile 1 in a manner of being relatively freely movable within a certain limit. In this connection, FIGS. 2 through 4 illustrate a few examples of the manner of supporting the pipe relative to the pile.

Figure 2:
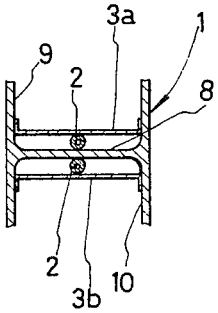
FIGS. 2 and 3 are cross sections, respectively showing a manner of supporting water guide pipes relative to an H-section pile, according to the invention.

Initially in FIG. 2 showing a cross section of an H-section pile 1, parallel with the web 8 of the pile, two guide members 3*a* and 3*b* are disposed respectively with space from the web 8 and secured at their side ends to flanges 9 and 10 of the pile. The water guide pipe 2 is supported movably within the limited space defined by the flanges 9 and 10, web 8 and guide member 3*a* or 3*b*.

Figure 3:
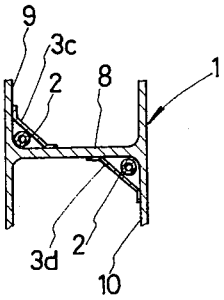

The illustration in FIG. 3 also is concerned with the instance of an H-section pile, and in this instance a guide member 3*c* is secured to the web 8 and flange 9, and another guide member 3*d* to the web 8 and flange 10. In the space formed by the web 8, flange 9 and guide member 3*c* and also the space formed by the web 8, flange 10 and guide member 3*d*, the water guide pipe 2 is disposed in a freely movable manner therein.

Figure 4:
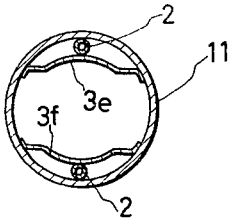
FIG. 4 is a view similar to FIGS. 2 and 3, showing an instance in which the pile comprises a cylindrical steel pipe.

FIG. 4 shows a cross section of a steel pipe pile 11, which has two pipe guide members 3*e* and 3*f* disposed with space from each other and secured to inner circumferetial portions thereof, dividing the sectional area of the hollow of the pipe 11 into a central larger portion formed between the two members 3*e* and 3*f* and two radially outer smaller portions formed between the pipe wall and the respective guide members. The water guide pipe 2 is received within each of the space corresponding to the smaller area portion formed between the pipe wall and the guide member 3*e* and the one corresponding to the other smaller area portion formed between the pipe wall and the guide member 3*f*.

The pipe guide member may be provided continuously along the length of the pile or only at a point or points along the same. Also, the position of attachment and the number of the pipe hanging member 6 such as a chain may be optionally determined.

In holding the pipe 2 and hanging it by the flexible support member 6 as described above, the pipe may be extended normally up to 1 to 4 m and, more preferably, 1.5 to 3 m distant from the bottom end 1*b* of pile 1. Further, the pipe 2 may preferably have a water jetting nozzle secured to its leading end portion.

The water jetting nozzle may be any of the known types, but in order to obtain a satisfactory performance of removal of crushed rock pieces, sand or the like, preferable may be to utilize a particularly devised nozzle.

Figure 6:
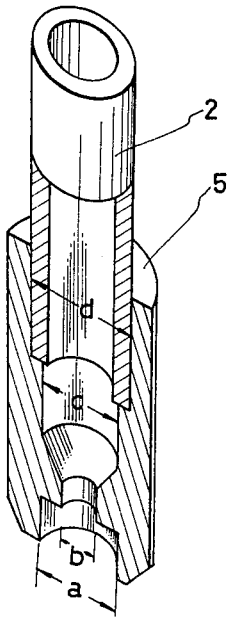
FIG. 6 is a sectional perspective view of the water jetting nozzle to be attached at the bottom of a pile according to the invention.

FIG. 6 shows an example of such particular nozzles, and in the nozzle 5 shown in FIG. 6, the values of a, b, c and d are 5, 3, 10 and 15 mm, respectively.

With regard to the size of H- or I-sections, steel pipes, steel sheet piles to be used as the pile for the practice of the present invention, there is no particular limitation, but smaller size piles are preferred to larger ones and for example in the case of steel pipe piles, their external and internal diameters may normally preferably be within a range of 15–25 mm and, more preferably, 18–25 mm, and 5–20 mm and, more preferably, 8–18 mm, respectively.

Further, in driving piles in an offshore condition as shown in FIG. 1, it is likely to be difficult to let the pile 1 to stand upright because an underwater rock bed often tends to be slanting and irregular about its surface and, in addition, the ambient water constantly undergoes flowing. In that event, it may be operated to set up a temporary work platform and, on the ship S, attach the water guide pipe 2 to pile 1 in a manner as shown in FIGS. 2 through 4, followed by a testing operation of the pump B and the nozzle 5. Further, subsequent to seating of pile 1 on the rock bed 4, the vibration pile driver A may be mounted on the head of the pile, followed by putting into operation the pressure pump B and the driver A to commence the pile driving operation.

It will be understood that an optimum output of the vibration pile driver is determinable, taking into consideration the particular kind of piles to be handled and the particular nature of the rock bed.

What is claimed is:

1. A pile driving method capable of driving a pile into ground having a hardness N value of greater than 50, comprising mounting a water guide pipe along a pile to be driven, said water guide pipe being vertically movable relative to said pile and slidably retained next to said pile, and while crushing the rock of the piling bed by hitting at the top of the pile and removing the crushed rocks by a high pressure water sent through said water guide pipe, driving the pile into the rock bed by a vibration pile driver.

2. A pile driving method as claimed in claim 1 further comprising timing the vertical motion of the pile generated by driving of the pile against the rock bed and repulsion of the rock bed, and the vertical motion of the water guide pipe generated due to its dead weight and counteraction from jetting of water under pressure, so that they are caused to take place in an alternate manner.

3. A pile driving method as claimed in claim 1, in which a single water guide pipe is mounted to the pile.

4. A pile driving method as claimed in claim 1, in which a plurality of water guide pipes are mounted to the pile.

5. A pile driving method as claimed in claim 1, in which said high pressure water has a pressure value within a range of 30–60 kg/cm$^2$.

6. A pile driving method as claimed in claim 1, in which said high pressure water is jetted in an amount within a range of 20–40 l/min. per guide pipe.

7. A pile driving method as claimed in claim 1, in which the water guide pipe is extended up to 1–4 m distant from the bottom end of the pile.

8. A pile driving method as claimed in claim 1, in which the pile comprises an H-section steel.

9. A pile driving method as claimed in claim 1, in which the pile comprises a steel pipe.

10. A pile driving method as claimed in claim 1, in which the pile comprises a steel sheet pile.

11. A pile driving method as claimed in claim 1, in which the pile comprises an I-section steel.

12. A pile driving method capable of driving a pile into ground having a hardness N value of greater than 50, comprising: mounting a water guide pipe along a pile to be driven, said water guide pipe being vertically movable relative to said pile and slidably retained next to said pile, said water guide pipe being extended up to 1–4 m distant from the bottom end of said pile; causing in an alternate manner the vertical motion of the pile generated by driving of the pile against the rock bed and repulsion of the rock bed and the vertical motion of the water guide pipe generated due to its dead weight and counteraction from jetting of water under pressure; removing the crushed rocks produced by driving the pile head against the rock bed through jetting a high water pressure sent through the water guide pipe in an amount within a range of 20–40 l/m and jetted under a pressure within a range of 30–60 kg/cm$^2$; and driving the pile by a vibration pile driver.

* * * * *